US009561423B2

(12) United States Patent
Roness

(10) Patent No.: US 9,561,423 B2
(45) Date of Patent: Feb. 7, 2017

(54) SCORECARD

(71) Applicant: PEG-IT AS, Torvastad (NO)

(72) Inventor: Bjorn Roness, Torvastad (NO)

(73) Assignee: PEG-IT AS, Torvastad (NO)

( * ) Notice: Subject to any disclaimer, the term of this patent is extended or adjusted under 35 U.S.C. 154(b) by 109 days.

(21) Appl. No.: 14/408,305

(22) PCT Filed: Jun. 18, 2013

(86) PCT No.: PCT/NO2013/050108

§ 371 (c)(1),
(2) Date: Dec. 16, 2014

(87) PCT Pub. No.: WO2013/191560

PCT Pub. Date: Dec. 27, 2013

(65) Prior Publication Data

US 2015/0190702 A1 Jul. 9, 2015

(30) Foreign Application Priority Data

Jun. 18, 2012 (NO) ..... 20120706

(51) Int. Cl.

| | |
|---|---|
| ***A63B 71/06*** | (2006.01) |
| ***A63B 57/00*** | (2015.01) |
| ***G06C 3/00*** | (2006.01) |

(52) U.S. Cl.

CPC ..... *A63B 71/06* (2013.01); *A63B 57/00* (2013.01); *A63B 71/0669* (2013.01); *A63B 71/0672* (2013.01); *G06C 3/00* (2013.01); *A63B 2071/0602* (2013.01); *A63B 2071/0694* (2013.01); *A63B 2225/15* (2013.01)

(58) Field of Classification Search

CPC ..... A63B 57/00; A63B 71/06; A63B 71/0669; A63B 71/0672; A63B 2071/0602; A63B 2071/0694; A63B 2225/15

USPC 116/222, 223, 224, 225, 306, 309; 235/1 B, 1 C; 340/323 R

See application file for complete search history.

(56) References Cited

U.S. PATENT DOCUMENTS 1,502,662 A * 7/1924 De Witt Fox ..... A63B 71/0672 116/223
1,785,288 A * 12/1930 Swarthout ..... A63B 71/0672 116/223

(Continued)

FOREIGN PATENT DOCUMENTS

GB 2011262 7/1979
GB 2374712 10/2002

(Continued)

OTHER PUBLICATIONS

Extended European Search Report, EP Patent Application No. 13806470.4, date of mailing Jan. 27, 2016.

*Primary Examiner* — R. A. Smith
(74) *Attorney, Agent, or Firm* — Andrus Intellectual Property Law, LLP

(57) ABSTRACT

A scorecard (1) and a method of recording the number of strokes in a game of golf by means of movable indicator devices (2) are described, the scorecard (1) being provided with at least one further movable indicator device (3) to enable the indication of a marker of a player, and a player indicator (4), and both the movable marker indicator (3) and the player indicator (4) being designed for mechanical, optical reading.

11 Claims, 4 Drawing Sheets

(56) References Cited

U.S. PATENT DOCUMENTS 2,489,805 A * 11/1949 O'Connor ..... A63B 71/0672 235/1 B
2,492,592 A 12/1949 Perry et al.
2,842,314 A 7/1958 McKennett
3,760,519 A * 9/1973 Niven ..... G06M 1/045 235/113
3,902,450 A * 9/1975 Bosshold ..... G09F 7/00 116/323
4,958,837 A * 9/1990 Russell ..... A63F 3/00088 273/252
4,998,726 A * 3/1991 Budnick ..... A63B 57/00 116/223
5,273,281 A * 12/1993 Lovell ..... A63F 3/065 273/138.1
5,319,548 A * 6/1994 Germain ..... A63B 71/06 273/DIG. 26
5,324,028 A * 6/1994 Luna ..... A63B 69/36 340/323 R
5,439,224 A * 8/1995 Bertoncino ..... A63B 71/0669 473/153
8,033,548 B2 * 10/2011 Shigeta ..... A63F 1/14 273/149 R
8,810,380 B2 * 8/2014 Leitz ..... A63B 71/0669 340/10.42
2004/0026493 A1 * 2/2004 Constantine ..... A63B 71/0669 235/375
2004/0155111 A1 * 8/2004 Truman et al. .... A63B 71/0672 235/470
2005/0240294 A1 * 10/2005 Jones et al. ..... A63B 57/00 700/92
2008/0318702 A1 * 12/2008 Fish ..... A63B 71/0672 473/131
2013/0029790 A1 * 1/2013 Clark ..... A63B 71/0669 473/407

FOREIGN PATENT DOCUMENTS

GB 2466942 B * 11/2012 ..... A63B 71/0672
WO 0197925 12/2001
WO WO 02094393 A1 * 11/2002 ..... A63B 71/0672
WO 2009/063133 5/2009

* cited by examiner

SCORECARD

FIELD

A scorecard and a method of recording the number of strokes in a game of golf by means of movable indicator devices are described.

BACKGROUND

When a game of golf is being played, the achievements of the individual player are measured by recording the number of strokes used on the individual golf hole. After the game is finished, the results from the individual hole are, in short, added up, and the player who has used the fewest number of strokes, possibly corrected for the so-called handicap of the player, has won the game.

The recording of the player's achievements is usually done after each hole played, by recording the number of strokes used for the individual hole on a so-called scorecard of paper by means of a pen or pencil, or a scorecard including movable indicators that are moved to a position expressing the number of strokes used. After the game is finished, the results are added up both for each individual hole and in total.

For the recorded result to be valid in a tournament and/or for changing the player's handicap, it is required that it should be confirmed by a marker. The marker is one of the other players who are playing in the same starting group. Marker tasks, that is to say who is going to be a marker of whom, will be distributed by the players in the starting group before start. In the course of the game, the player and the marker each record the number of strokes used by the player on a respective scorecard. After the game is finished, the values that the player and marker have recorded are compared. If they agree, the result is approved and the player and marker attest that the result is correct.

In many cases, a golfer will additionally compile statistics from some chosen results in a round of golf. This may be fairway hits, out of bunker in one stroke and the number of putter strokes used. These results are often kept, preferably for comparison with the statistics of a round played later on the same golf course.

Especially in connection with tournaments, there is a wish to record the results of the golf game in a scoring list or a database as quickly as possible, with the least possible time consumption and with the least possible risk of errors in the recording.

For this recording to take place in the simplest possible way, optical recording devices already known may be utilized. They take a picture of the scorecard and the picture is transferred to a computer, in which software reads the results from the picture. The results are processed by the computer by means of the software and, thus, the result may be provided relatively quickly. This system is referred to hereinafter as a reading system.

However, these reading systems turn out to have difficulties in recognizing and interpreting the handwriting of some people. A known solution to this problem is a scorecard intended for mechanical optical reading, wherein the scorecard has been realized in a design in which movable indicators uncover predefined values that the software has been programmed to recognize.

The optical recording device may also be used to compare the player's scorecard with a scorecard in which the marker has recorded the player's results, and validate these.

To simplify the reading operation further, a plural number of scorecards may be placed on the reading system at the same time, after which a reading system is arranged to recognize each scorecard and read it as an isolated scorecard. The drawback of this solution is how to make a flexible identification of the marker and the player.

A system like that is known from the applicant's Norwegian patent application NO20120187 which discloses a reversible scorecard for recording the number of strokes in a game of golf, wherein the number of strokes used to complete a golf hole is recorded in the scorecard in a binary number system, characterized by the scorecard being provided with a plurality of spaced-apart indicator devices, each of the indicator devices being arranged to be moved to any one of the at least a first position and a second position, and each of the indicator devices placed in the first position showing a first indicator picture which is mechanically optically distinguishable from a second indicator picture which is shown when the indicator device is placed in the second position.

Said system has turned out to work excellently with respect to recording speed and accuracy. However, it is riddled with some drawbacks with respect to providing a flexible identification of the marker and connecting him to a player. This must be indicated and connected manually in the system.

SUMMARY

The invention has for its object to remedy or reduce at least one of the drawbacks of the prior art or at least provide a useful alternative to the prior art.

The object is achieved through features which are specified in the description below and in the claims that follow.

In a first aspect, the invention relates more specifically to a scorecard for recording the number of strokes in a game of golf by means of movable indicator devices, characterized by the scorecard being provided with at least one further movable indicator device for the indication of a marker of a player, and a player indicator, and by both the movable marker indicator and the player indicator being designed for mechanical, optical reading.

Who will be the marker of whom is decided by the players in a starting group before starting the golf round. A starting group normally consists of two to four players. In the set-up of the starting group, each player has a unique number from one to four. This number is used to indicate a marker. When, for example, player number one is chosen as the marker of player number three, the marker indicator is moved so that it indicates marker number one on the scorecard on which the result of player three is to be recorded.

In one embodiment, like the marker indicator, the player indicator may include at least one movable indicator device. Thus, both the marker indicator and the player indicator may be movable. Like the marker indicator, the player indicator can be moved so that the player indicator expresses the same number as the player has been assigned in the starting group.

In another embodiment, the player indicator may include a bar code. The bar code may contain information or a reference to information about the player. This has the effect, when this bar code is being read in a suitable reading system, of enabling quick access to information about the player and identification thereof, either directly from the bar code, or via a reference in the bar code.

In a third version, the player indicator may include at least a movable indicator device and a bar code.

The scorecard may further be provided with a result card arranged for recording, in a binary number system, at least some of the golf strokes for statistical purposes, the result card being provided with a plurality of spaced-apart indicator devices, each of the indicator devices being arranged to be movable to any one of the at least one first position and one second position, and each of the indicator devices placed in the first position showing a first indicator picture which is mechanically optically distinguishable from a second indicator picture which is shown when the indicator device is placed in the second position. This has the effect of enabling the golfer's statistics to be recorded on the same unit as that on which the number of golf strokes is recorded.

In a second aspect, the present invention relates more specifically to a method of using a scorecard in accordance with claim 1, the method including the following steps:

- recording the starting group of players in a computer system;
- deciding and indicating the marker of the respective player of the starting group by means of the marker-indicator device;
- the player and the marker recording the number of strokes of the player during the course of the game;
- at a specified post, the recordings of the player and the marker and also the player indicator and marker indicator are read by means of a mechanical, optical reading device, and the data recorded are transferred to said computer system for comparison and checking that the recordings of the player and marker are identical, and for processing and presentation of results.

The distribution of marker responsibilities within the starting group may be carried out immediately before the golf game is started. This has the effect that if any player in the starting group fails to appear, it will not cause any problems in the distribution, as the number of the player failing to appear will not be designated as a marker on any of the others' scorecards.

The method may further include recording at least some of the strokes, by means of a result card as described above, for use for statistical purposes, by adjusting one or more of the indicator devices so that the values of the indicator pictures express the desired recordings. When a player achieves the desired ball positioning after a stroke, this is marked on the result card.

The method may further include reading the result card by means of a mechanical, optical reading device, and the recorded data are transferred to said computer system for processing, storing and presentation of results.

BRIEF DESCRIPTION OF THE DRAWINGS

In what follows, an example of a preferred embodiment is described, which is visualized in the accompanying drawings, in which.

DETAILED DESCRIPTION OF THE DRAWINGS

Figure 1:
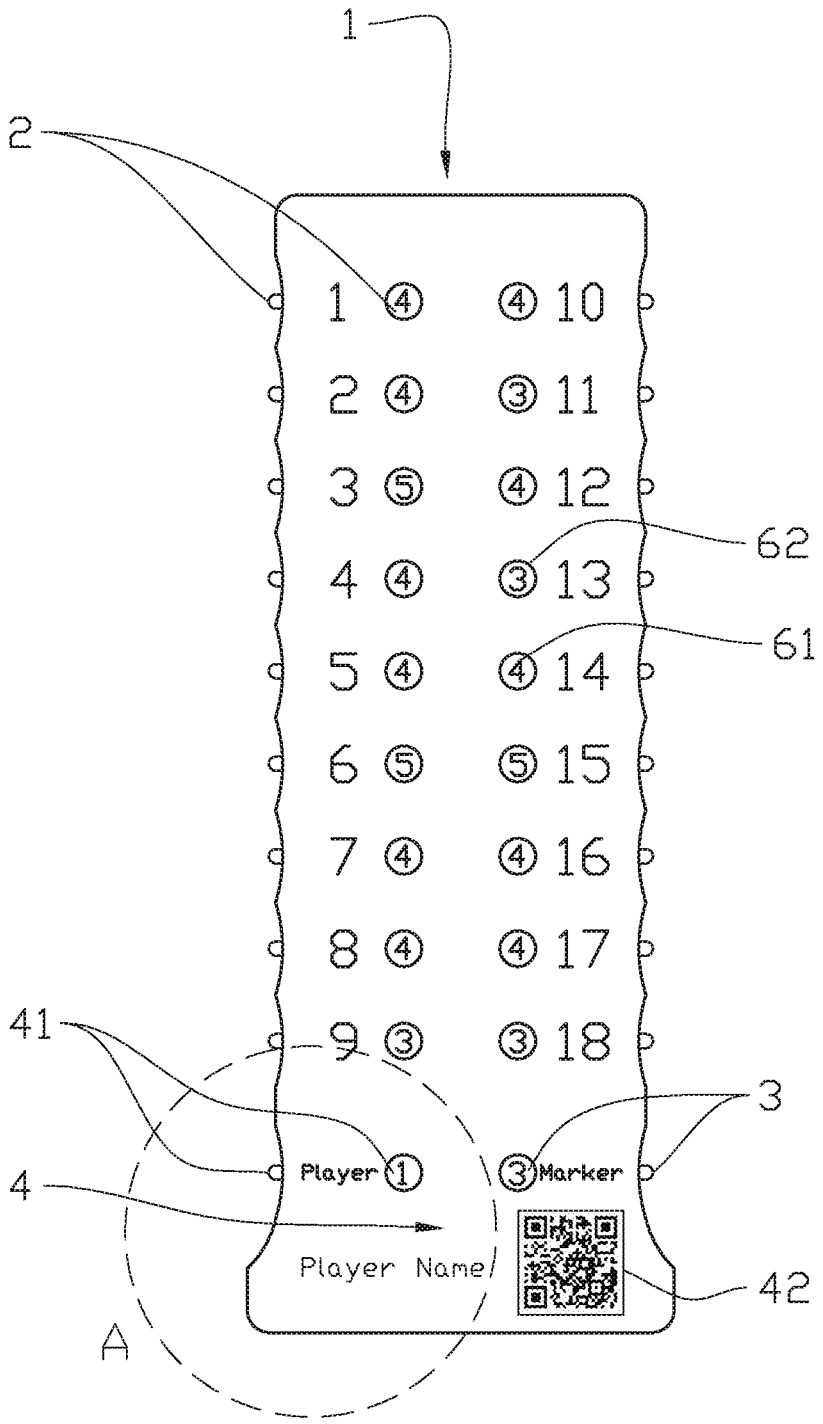
FIG. 1 shows a view of a first face of a scorecard according to the invention.

In the figures, the reference numeral 1 indicates a scorecard in accordance with the invention. The scorecard 1 is provided with eighteen movable indicator devices 2 arranged for recording the number of strokes used on each golf hole played. The scorecard 1 is further provided with a movable indicator device 3 arranged for the indication of the player number of the player chosen as a marker and a player indicator 4 which includes a movable indicator 41 and a bar code 42.

The movable indicators 2, 3, 41 are wheels 6 that are embedded in the scorecard 1 and attached in such a way that they can be rotated around their own centre axes. In the surface of the scorecard 1, an opening 62 has been formed, making a portion of the embedded wheel 6 visible. The wheel 6 is provided with printed numerals 61 which may be made visible through the opening 62 so that the wheel 6 may be rotated until the numeral 61 expressing the desired value is shown in the opening 62. The wheel 6 is provided with a braking device (not shown) which can prevent unintentional rotation.

Figure 4:
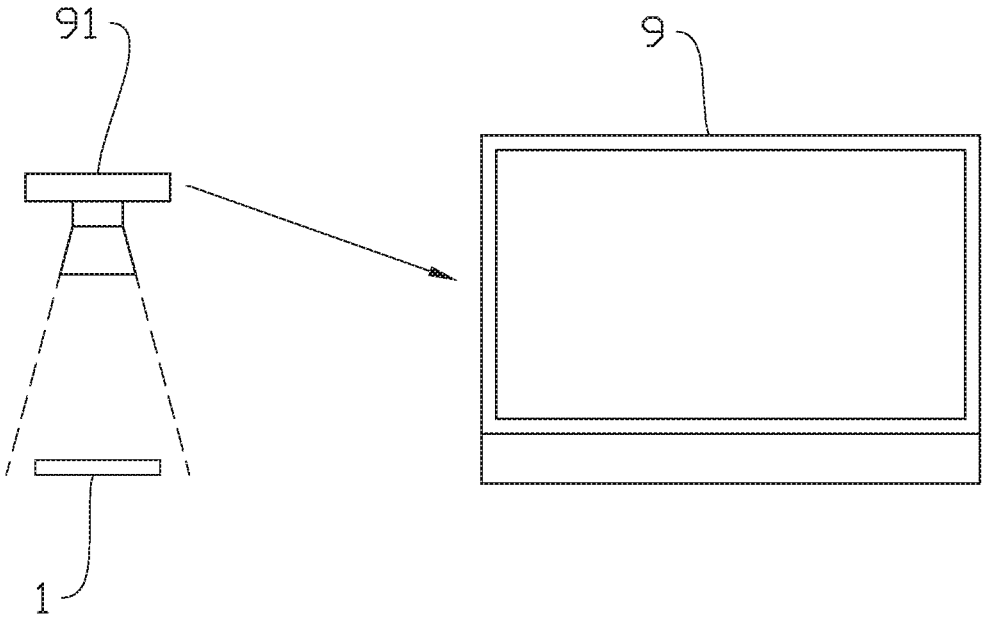
FIG. 4 shows a principle drawing of a recording system for the optical reading of scorecards and result cards and electronic processing of the data.

Before a round of golf, a starting group is set up in a recording system 9 (see FIG. 4) and each player is assigned a player number in this starting group. The player adjusts the movable player indicator 41 on the scorecard 1 so that the numeral 61 (see FIG. 2) shown expresses the player's assigned player number. When the players in this starting group turn up to play, they decide between themselves who is going to be the marker of each individual player. On the scorecard 1, the marker indicator 3 is adjusted so that the numeral 61 shown expresses the marker's assigned player number. In the example shown in FIG. 1, the results of the player who has been assigned the player number one are recorded. The marker of player number one is the player who has been assigned the player number three. Correspondingly, the player numbers two, three and four in the starting group are also assigned a marker so that all the players have been assigned one other player as a marker. During the course of the game, the player and the marker each record the number of strokes that the player uses on each golf hole in a respective scorecard 1. When the result is to be read, the scorecards 1 are positioned in such a way that a mechanical, optical reading device 91 makes an image which is transferred to a recording system 9. The recording system 9 recognizes each of the scorecards 1 and reads the numerical values 61 that are shown in the openings 62 of the indicator devices 2, 3, 41 and the bar code 42 and processes these data by means of a computer program developed by the present applicant. By means of the data from the bar code 42 and the player indicator 41, the recording system 9 identifies the player's ID and then which starting group the player has participated in.

If a scorecard without a bar code 42 is used, or the bar code 42 does not contain or refer to the player's unique ID, the starting group ID must be entered manually into the recording system 9. By means of this information, together with the marker number read from the marker indicator 3, the recording system checks, records, processes and presents the results taken from the scorecards 1.

The recording read from the player's (player number one in the embodiment shown) scorecard 1 is compared with the read recordings appearing from that of the marker (player number three in the embodiment shown). If the recordings are identical, the result will be approved. If there is a difference in said recordings, the recording system 9 will give a warning about this.

The result card 5 is arranged on the back of the scorecard 1. The result card consists of a reversible scorecard known from the patent application NO20120187. The difference in relation to the scorecard for which a patent has been applied for is that the columns of indicator devices 51 have been assigned other values and tasks.

The exemplary embodiment shows a scorecard 1 with eighteen recording devices 2 for recording the number of strokes. In a game of golf in which eighteen holes are played, each player will have to be equipped with two scorecards 1. One for recording his own result and one for recording the result of the player whose marker the player has been chosen to be. In another embodiment, the scorecard 1 may be provided with thirty-six recording devices so that each player will only need one scorecard 1 to record the results.

Figure 2:
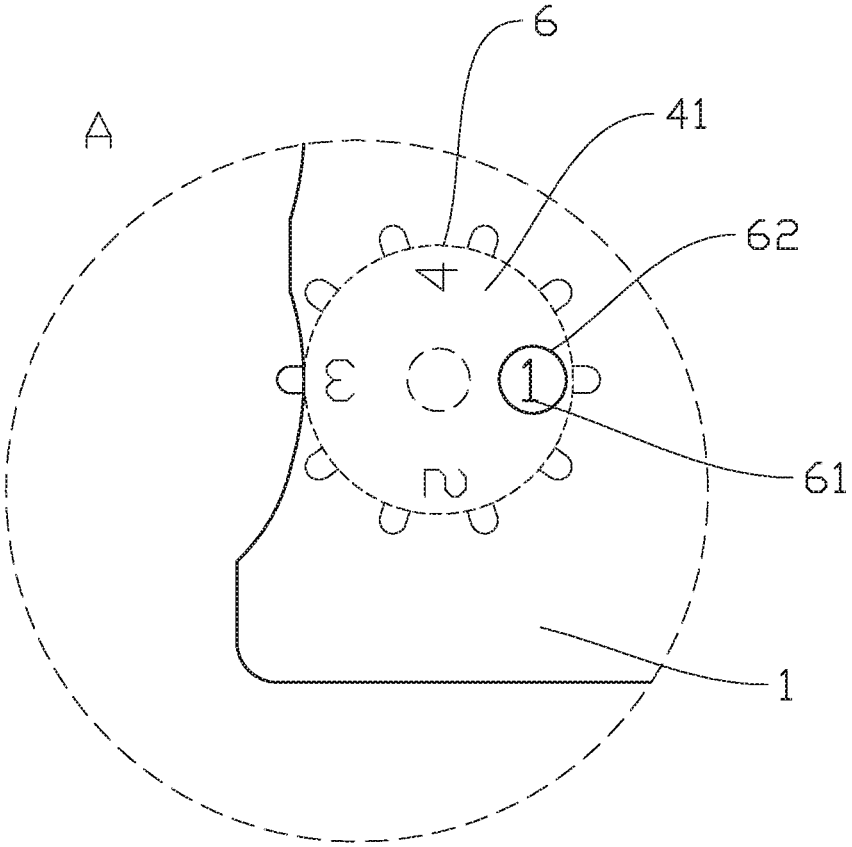
FIG. 2 shows, on a larger scale, a detail A shown in FIG. 1, in which an indicator device in the form of a wheel is indicated.
Figure 3:
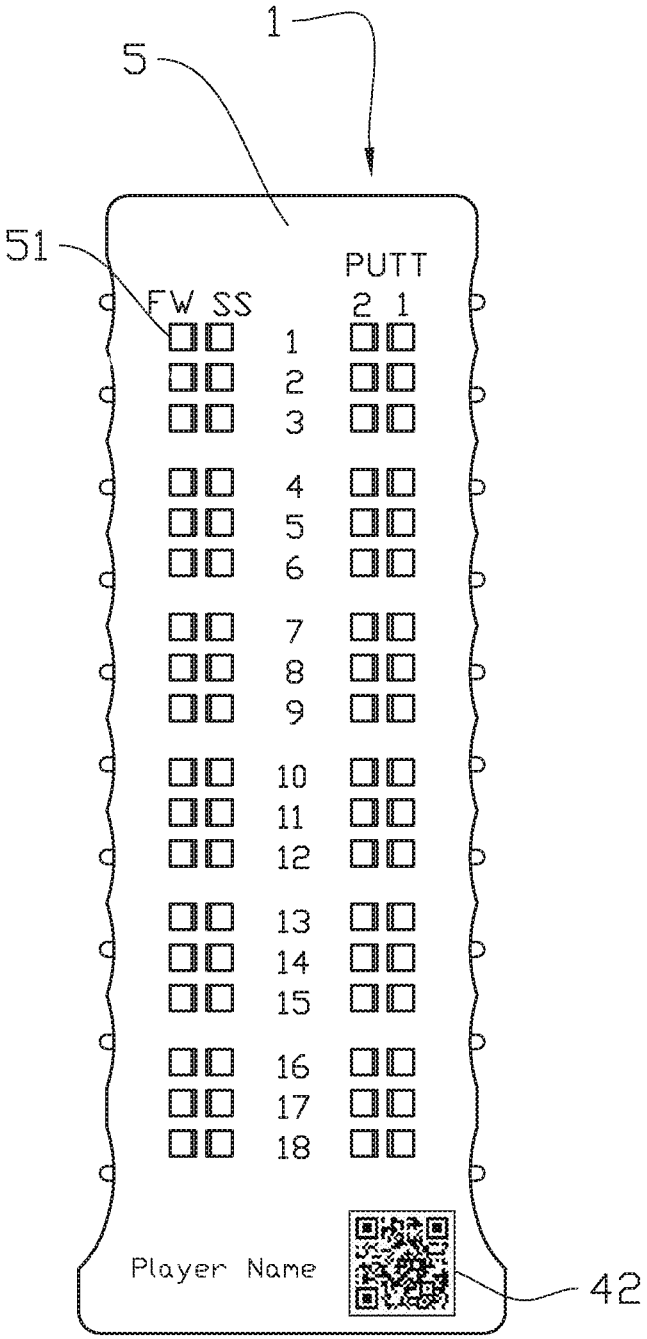
FIG. 3 shows a view of a second face of the scorecard shown in FIG. 1, in which a result card is arranged.

In FIG. 2, an indicator device 41 for indicating a player number is shown. The marker indicator 3 is of the same design. FIG. 1 shows the indicator device 41 provided with the numerals 1-4. However, it will be understood that the indicator devices 3, 41 are not restricted to being provided with these numerals. For example, these indicator devices 3, 41 may be of the same design as the indicators 2 for recording the number s of strokes.

The invention claimed is:

1. A scorecard for a game of golf, the scorecard comprising:

a plurality of movable indicator devices for recording a number of golf strokes used by a player on a plurality of golf holes;

a further movable indicator device configured to indicate a marker of the player; and a player indicator;

wherein the further movable indicator device and the player indicator are configured for mechanical, optical reading.

2. The scorecard in accordance with claim 1, wherein the player indicator comprises a movable indicator device.

3. The scorecard in accordance with claim 1, wherein the player indicator comprises a bar code.

4. The scorecard in accordance with claim 1, wherein the player indicator comprises a movable indicator device and a bar code.

5. The scorecard in accordance with claim 1, further comprising a result card that is configured for recording at least some of the number of golf strokes in a binary system for statistical purposes.

6. The scorecard according to claim 5, wherein the result card comprises a plurality of spaced-apart indicator devices that are configured to move into and between a first position wherein a first indicator picture is shown and a second position wherein a second indicator picture is shown that is mechanically, optically distinguishable from the first indicator picture.

7. A method of using a scorecard for a game of golf, the scorecard comprising a plurality of movable indicator devices for recording a number of golf strokes used by a player on a plurality of golf holes; a further movable indicator device configured to indicate a marker of a player; and a player indicator; wherein the further movable indicator device and the player indicator are configured for mechanical, optical reading; the method comprising:

recording a starting group of players in a computer system;

selecting and indicating via the further movable indicator device a marker of each respective player in the starting group of players;

wherein during the game of golf, each respective player and each marker for that respective player records the number of strokes used by the respective player;

thereafter reading, via a mechanical optical reading device, recordings of each player, marker, player indicator, and further movable indicator device;

transferring the recordings to the computer system;

comparing and checking, with the computer system, that the recordings are consistent with each other.

8. The method according to claim 7, further comprising processing the recordings and presenting results based on the recordings.

9. The method according to claim 7, further comprising recording at least some of the golf strokes used by a player via a result card for statistical purposes.

10. The method according to claim 7, further comprising processing the recordings and presenting results based on the readings.

11. The method according to claim 10, further comprising reading the result card with a mechanical, optical reading device and transferring the recordings to the computer system for processing and presenting the results.

* * * * *